US009645543B2

(12) United States Patent
Kubota et al.

(10) Patent No.: US 9,645,543 B2
(45) Date of Patent: May 9, 2017

(54) CLEANING DEVICE WITH SEALING OF SUPPORTING PLATE

(71) Applicant: CANON KABUSHIKI KAISHA, Tokyo (JP)

(72) Inventors: Hitoshi Kubota, Tokyo (JP); Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/994,481

(22) Filed: Jan. 13, 2016

(65) Prior Publication Data

US 2016/0209799 A1 Jul. 21, 2016

(30) Foreign Application Priority Data

Jan. 15, 2015 (JP) ..... 2015-005622

(51) Int. Cl.
*G03G 21/00* (2006.01)

(52) U.S. Cl.
CPC ..... *G03G 21/0029* (2013.01)

(58) Field of Classification Search
CPC ..... G03G 21/0029
USPC ..... 399/102, 103, 105, 351
See application file for complete search history.

(56) References Cited

U.S. PATENT DOCUMENTS 8,244,156 B2 8/2012 Iwamoto et al.
8,422,908 B2 * 4/2013 Lee ..... G03G 21/1832 399/102
8,805,233 B2 * 8/2014 Akamatsu ..... G03G 21/0029 399/102
2002/0064392 A1 * 5/2002 Miura ..... G03G 21/1814 399/103
2008/0145093 A1 * 6/2008 Fukuta ..... G03G 15/0898 399/103
2013/0016993 A1 * 1/2013 Akamatsu ..... G03G 21/0029 399/102

FOREIGN PATENT DOCUMENTS

JP 2010-002681 A 1/2010

* cited by examiner

*Primary Examiner* — Sophia S Chen

(74) *Attorney, Agent, or Firm* — Fitzpatrick, Cella, Harper & Scinto

(57) ABSTRACT

A cleaning device includes a cleaning member including a cleaning blade and a supporting plate for supporting the cleaning blade; a frame; first and second fixing portions, provided on the frame, for fixing the supporting plate in one end side and the other end side with respect to a longitudinal direction of the cleaning blade; a recessed portion provided on the frame at a position between the first and second fixing portions with respect to the longitudinal direction and recessed more than the first and second fixing portions in a direction away from the supporting plate; and a sealing material, applied onto the recessed portion within a range of the first and second fixing portions with respect to a perpendicular direction to the longitudinal direction, for sealing between the supporting plate fixed on the first and second fixing portions and the recessed portion.

13 Claims, 5 Drawing Sheets

CLEANING DEVICE WITH SEALING OF SUPPORTING PLATE

FIELD OF THE INVENTION AND RELATED ART

The present invention relates to a cleaning device for scraping off a deposited matter on a surface of an object-to-be-cleaned, and specifically relates to a cleaning device suitable for cleaning of an image bearing member of an image forming apparatus for forming an image.

A conventional image forming apparatus of an electrophotographic type has been widely used as a copying machine, a printer, a facsimile machine, a multi-function machine having a plurality of functions of these machines, or the like. In the image forming apparatus of this type, a toner image is formed on a surface of a photosensitive drum provided in an image forming unit and then a cleaning member such as a cleaning blade is press-contacted to the surface of the photosensitive drum, so that a transfer residual toner on the photosensitive drum is scraped off. The transfer residual toner scraped off is collected in a collecting container.

The cleaning blade consists of an elastic member and is provided integrally with a blade supporting member (hereinafter referred to as a supporting plate), and this supporting plate is fixed to the collecting container, so that a structure in which the cleaning blade is fixed to the collecting container has become widespread (Japanese Laid-Open Patent Application 2010-2681). Here, when the transfer residual toner scraped off from the photosensitive drum leaks out to an outside through between the collecting container and the supporting plate, an inside of an apparatus main assembly of the image forming apparatus is contaminated with the transfer residual toner, and therefore there is a need to seal between the collecting container and the supporting plate. For this purpose, in some cases, a liquid material, such as a hotmelt, which is applied and then coagulates is used. The hotmelt after the coagulation is an elastic member, and therefore is capable of effectively sealing between the collecting container and the supporting plate.

However, the hotmelt after the coagulation is the elastic member and urges a portion between the collecting container and the supporting plate in a direction in which the collecting container and the supporting plate are spaced from each other. For this reason, when an application position of the hotmelt is disposed at a position close to a supporting plate mounting portion with respect to a widthwise (short) direction of the cleaning blade, a moment for increasing a contact pressure of the cleaning blade is generated, so that there is a liability that improper cleaning, turning-up of the cleaning blade and unusual noise are generated. On the other hand, when the application position of the hotmelt is disposed at a position remote from the supporting plate mounting portion with respect to the widthwise direction of the cleaning blade, the contact pressure of the cleaning blade is not increased, so that there was a liability that the improper cleaning is generated.

SUMMARY OF THE INVENTION

A principal object of the present invention is to provide a cleaning device capable of suppressing an influence on a blade contact pressure while maintaining a sealing property.

According to an aspect of the present invention is to provide a cleaning device for cleaning an image bearing member for bearing an image, comprising: a cleaning member including a cleaning blade for removing a developer on the image bearing member and a supporting plate for supporting the cleaning blade; a frame for supporting the cleaning blade and for collecting the developer scraped off by the cleaning blade; first and second fixing portions, provided on the frame, for fixing the supporting plate in one end side and the other end side with respect to a longitudinal direction of the cleaning blade; a recessed portion provided on the frame at a position between the first and second fixing portions with respect to the longitudinal direction and recessed more than the first and second fixing portions in a direction away from the supporting plate; and a sealing material, applied onto the recessed portion within a range of the first and second fixing portions with respect to a perpendicular direction to the longitudinal direction, for sealing between the supporting plate fixed on the first and second fixing portions and the recessed portion.

Further features of the present invention will become apparent from the following description of exemplary embodiments with reference to the attached drawings.

DESCRIPTION OF THE EMBODIMENTS

In the following, an embodiment of the present invention will be specifically described with reference to FIG. 1 to (b) of FIG. 4. In this embodiment, as an example of an image forming apparatus, a full-color printer of a tandem type is described. However, the image forming apparatus in the present invention is not limited to the full-color printer of the tandem type but may also be an image forming apparatus of another type. Further, the image forming apparatus is not limited to the full-color image forming apparatus, but may also be an image forming apparatus for forming a monochromatic image or a mono-color image.

Figure 1:
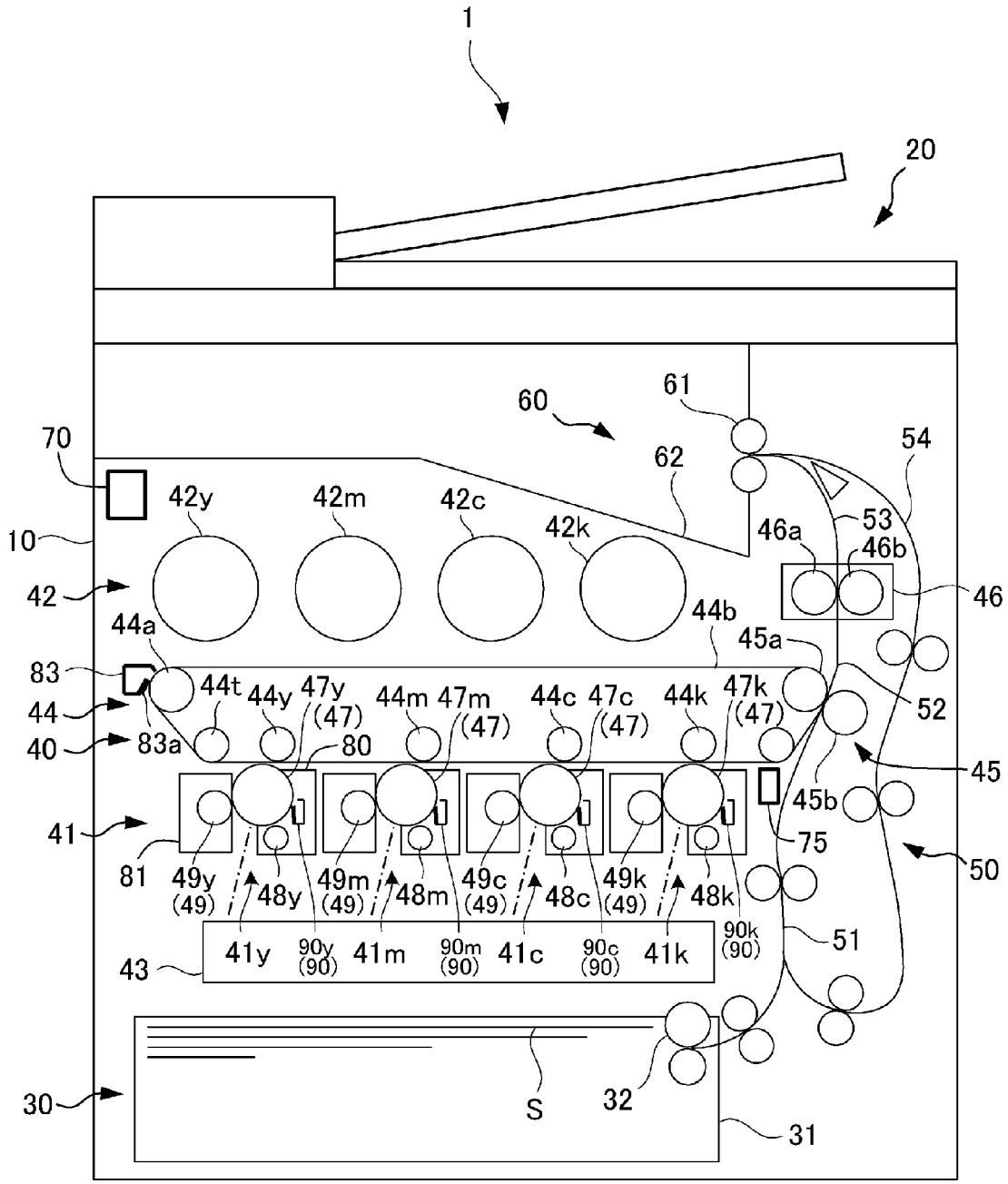
FIG. 1 is a schematic sectional view of an image forming apparatus in an embodiment of the present invention.

As shown in FIG. 1, an image forming apparatus 1 includes an image forming apparatus main assembly 10. Further, the apparatus main assembly 10 includes an image reading portion 20, a sheet feeding portion 30, an image forming portion 40, a sheet feeding portion 50, a sheet discharging portion 60, a controller 70. On a sheet S as a recording material, a toner image is to be formed, and specific examples of the sheet S may include plain paper, a synthetic resin material sheet as a substitute for the plain paper, thick paper, a sheet for an overhead projector, and the like.

The image reading portion 20 is provided at an upper portion of the apparatus main assembly 10. The image reading portion 20 includes an unshown platen glass as an original carriage, an unshown light source for irradiating an original placed on the platen glass with light, an unshown image sensor for converting reflected light into a digital signal, and the like.

The sheet feeding portion 30 is disposed at a lower portion of the apparatus main assembly 10, and includes a sheet cassette 31 for stacking and accommodating the sheet S and includes a feeding roller 32. The sheet feeding portion 30 feeds the sheet S to the image forming portion 40.

The image forming portion 40 includes an image forming unit 41, a toner bottle 42, a laser scanner 43, an intermediary transfer unit 44, a secondary transfer portion 45 and a fixing device 46 and effects image formation.

The image forming unit 41 includes four image forming units 41*y*, 41*m*, 41*c* and 41*k* for forming toner images of four colors of yellow (y), magenta (m), cyan (c) and black (k), respectively. Each of the image forming units is detachably mountable to the apparatus main assembly 10 by a user. Hereinafter, the image forming unit 41*y* will be described, but the other image forming units 41*m*, 41*c* and 41*k* have the same structure as that of the image forming unit 41*y* except that colors of toners accommodated therein are different from the color of the toner in the image forming unit 41*y*, and therefore will be omitted from detailed description. Similarly, the toner bottle 42 includes four toner bottles 42*y*, 42*m*, 42*c* and 42*k*corresponding to the four colors. Hereinafter, the toner bottle 42*y* will be described, but the toner bottles 42*m*, 42*c* and 42*k* have the same structure as that of the toner bottle 42*y* except that colors of toners accommodated therein are different from the color of the toner in the toner bottle 42*y*, and therefore will be omitted from detailed description.

For example, the image forming unit 41*y* includes a photosensitive (member) unit 80 and a developing unit (developing carrying device) 81. The photosensitive unit 80 includes a photosensitive drum (image bearing member) 47*y* for forming a toner image, a charging roller 48*y* and a drum cleaning device 90*y*. The photosensitive drum 47*y* is exposed upward and is contactable to an intermediary transfer belt 44*b*. In this embodiment photosensitive drums 47*y*, 47*m*, 47*c*, 47*k* are collectively described as a photosensitive drum 47, and similarly, cleaning devices 90*y*, 90*m*, 90*c*, 90*k* are collectively described as a cleaning device 90. The photosensitive drum 47 rotates (moves) while carrying an electrostatic image. A structure of the cleaning device 90 will be described later in detail.

The developing unit 81 includes a developing sleeve (developer carrying member) 49*y*, unshown first and second feeding screws for stirring a developer (a toner and a carrier), an unshown developing blade, and the like. The developing sleeve 49*y* is rotationally driven relative to the photosensitive drum 47*y*, so that the developer is carried and fed to the photosensitive drum 47*y*. To the developing unit 81, the toner is supplied from the toner bottle 42*y* in which the toner is filled. In this embodiment, developing sleeves 49*y*, 49*m*, 49*c*, 49*d* are collectively described as a developing sleeve 49. A structure of the developing unit 81 is similar to that of a conventionally known developing unit, and therefore will be omitted from detailed description. The structure of the developing unit 81 is the same as the structure of a conventionally known developing unit, and therefore will be omitted from detailed description.

The laser scanner 43 is an exposure means for exposing surface of the photosensitive drum 47 to light to form an electrostatic latent image on the surface of the photosensitive drum 47.

The intermediary transfer unit 44 is disposed above the image forming unit 41. The intermediary transfer unit 44 includes a driving roller 44*a*, a tension roller 44*t*, a plurality of primary transfer rollers 44*y*, 44*m*, 44*c* and 44*k*, and the intermediary transfer belt 44*b* which consists of an endless belt and which is wound around these rollers. The primary transfer rollers 44*y*, 44*m*, 44*c* and 44*k* are disposed opposed to the photosensitive drums 47 and are disposed in contact with the intermediary transfer belt 44*b*. A positive transfer bias is applied to the intermediary transfer belt 44*b* by the primary transfer rollers 44*y*, 44*m*, 44*c* and 44*k*, whereby toner images having a negative polarity are superposedly transferred successively from the photosensitive drum onto the intermediary transfer belt 44*b*. As a result, a full-color image is formed on the intermediary transfer 44*b*.

The intermediary transfer belt 44*b* is circulated and driven (rotationally moved) at a predetermined speed by the various rollers. The driving roller 44*a* is driven by a motor excellent in a constant speed property and circulates and drives the intermediary transfer belt 44*b*. The tension roller 44*t* applies a certain tension to the intermediary transfer belt 44*b*.

The secondary transfer portion 45 includes a secondary transfer inner roller 45*a* and a secondary transfer outer roller 45*b*. By applying a positive secondary transfer bias to the secondary transfer outer roller 45*b*, the full-color image formed on the intermediary transfer belt 44*b* is transferred onto the sheet S. The secondary transfer inner roller 45*a* stretches the intermediary transfer belt 44*b* at an inside of the intermediary transfer belt 44*b*, and the secondary transfer outer roller 45*b* is provided at a position opposing the secondary transfer inner roller 45*a* via the intermediary transfer belt 44*b*.

In a side, of the intermediary transfer belt 44*b*, downstream of a secondary transfer portion 45, a cleaning device 83 for cleaning a surface of the intermediary transfer belt 44*b* by removing a residual toner and paper powder on the intermediary transfer belt 44*b* after the secondary transfer is provided. The cleaning device 83 is provided with a cleaning blade 83*a* contacting the surface of the intermediary transfer belt 44*b*.

Between the image forming unit 41 and the secondary transfer portion 45, a density detecting sensor 75 capable of measuring a density of the toner image formed on the intermediary transfer belt 44*b* is provided opposed to the intermediary transfer belt 44*b*. The density detecting sensor 75 is constituted by a photo-sensor, for example, and is connected with the controller 70.

The fixing device 46 includes a fixing roller 46*a* and a pressing roller 46*b*. The sheet S is nipped and fed between the fixing roller 46*a* and the pressing roller 46*b*, so that the toner image transferred on the sheet S is pressed and heated to be fixed on the sheet S. The fixing device 46 constitutes a single unit and is insertable into and demountable from the apparatus main assembly 10.

The sheet feeding portion 50 feeds the sheet S, fed from the sheet feeding portion 30, from the image forming portion 40 to the sheet discharging portion 60, and includes a pre-secondary transfer feeding path 51, a pre-fixing feeding path 52, a discharging path 53, and a (re-)feeding path 54.

The sheet discharging portion 60 includes a discharging roller pair 61 provided in a downstream side of the discharging path 53 and includes a discharge tray 62 provided in a downstream side of the discharging roller pair 61. The discharging roller pair 61 feeds the sheet S, fed from a nip along the discharging path 53, to discharge the sheet S onto the discharge tray 62.

The controller 70 is constituted by a computer and, e.g., includes CPU, a memory for storing a program for controlling respective portions and for storing temporary data, and an input-and-output circuit for inputting and outputting signals relative to an external device. The CPU is a microprocessor for effecting entire control of the image forming apparatus 1 and is a principal part of a system controller. The CPU is connected via the input-and-output circuit with each of the sheet feeding portion 30, the image forming portion 40, the sheet feeding portion 50 and the sheet discharging portion 60, and transfers signals with the respective portions and controls operations of the respective portions. The memory includes, for example, ROM, EEPROM, RAM and the like. To the input-and-output circuit, for example, the density detecting sensor 75 is connected. Further, the controller 70 enables an operation and setting by the user through an instruction from an unshown computer connected with the apparatus main assembly 10, an operation of an unshown operating portion or the like.

An image forming operation in the image forming apparatus 1 constituted as described above will be described with reference to FIG. 1.

As shown in FIG. 1, when the image forming operation is started, first, the photosensitive drums 47*y*, 47*m* 47*c* and 47*k* are rotated, and the surfaces thereof are electrically charged by the charging rollers 48*y*, 48*m*, 48*c* and 48*k*, respectively. Then, the laser scanner 43 emits, on the basis of image information, laser light toward the surface of each of the photosensitive drums 47*y*, 47*m*, 47*c* and 47*k*, so that an electrostatic latent image is formed on the surface of each of the photosensitive drums 47*y*, 47*m*, 47*c* and 47*k*. The toner is deposited on the electrostatic latent image to develop (visualize) the electrostatic latent image into a toner image, and then the toner image is transferred onto the intermediary transfer belt 44*b*. As this time, with an increasing potential difference which is a difference between an exposure amount and a bias applied to the developing sleeve 49, an amount of the toner used for development increases. The toner image obtained by the visualization of the electrostatic latent image is transferred onto the intermediary transfer belt 44*b*.

On the other hand, in parallel to such a toner image forming operation, the feeding roller 32 is rotated to feed the uppermost sheet S in a sheet cassette 31 while separating the sheet S. Then, the sheet S is fed to the secondary transfer portion 45 via the pre-secondary transfer feeding path 51 by being timed to the toner image on the intermediary transfer belt 44*b*. Then, the toner image is transferred from the intermediary transfer belt 44*b* onto the sheet S, and the sheet S is fed into the fixing device 46, in which the (unfixed) toner image is heated and pressed, thus being fixed on the surface of the sheet S. The sheet S is discharged by the discharging roller pair 61, so that the sheet S is stacked on the discharge tray 62.

Figure 4:
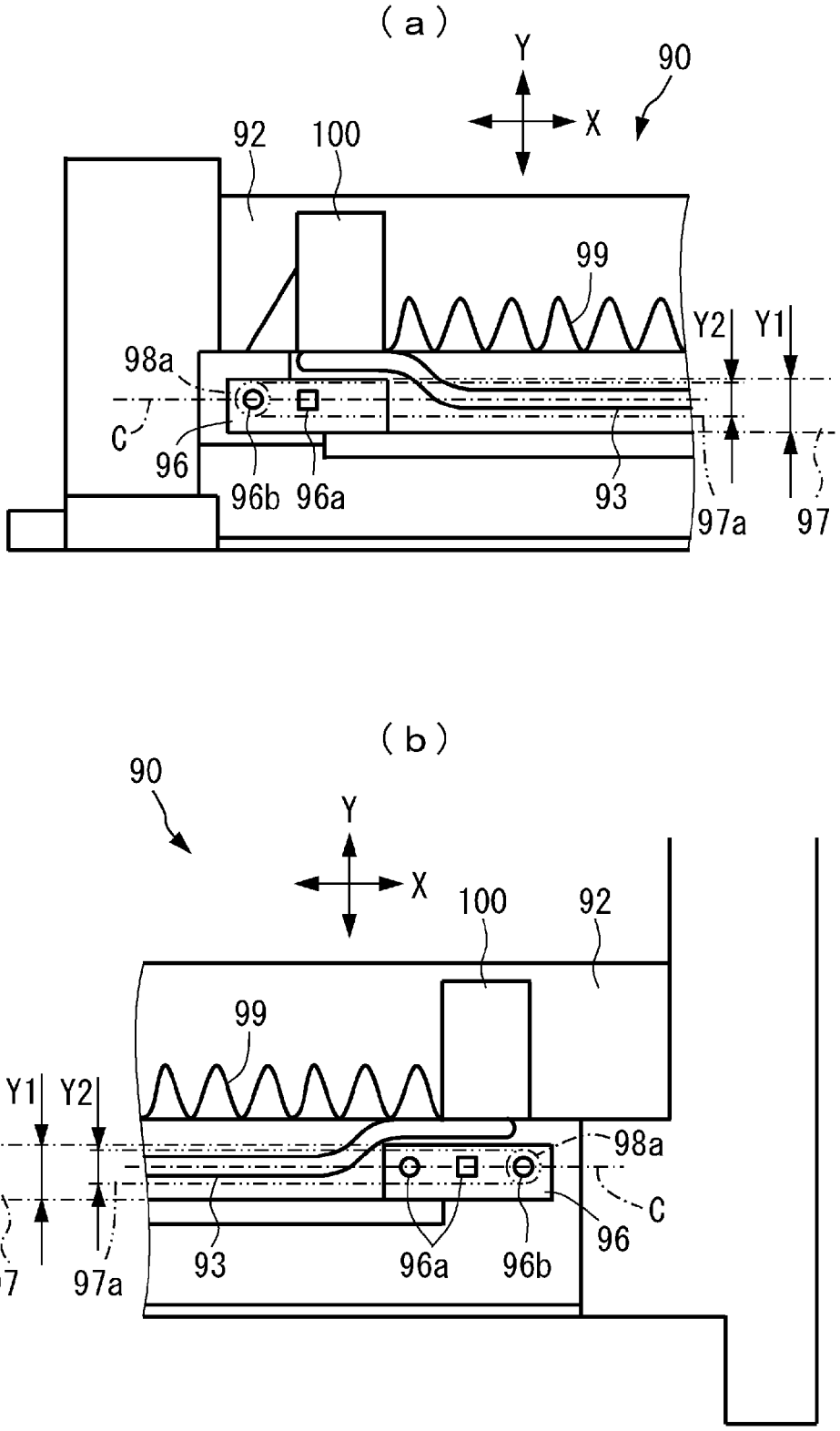
In FIG. 4, (a) and (b) are enlarged front views of the cleaning device in the embodiment, wherein (a) shows a left-side end portion in FIG. 3, and (b) shows a right-side end portion in FIG. 3.

The cleaning device 90 of the image forming apparatus 1 described above will be specifically described using FIG. 2 to (b) of FIG. 4.

Figure 2:
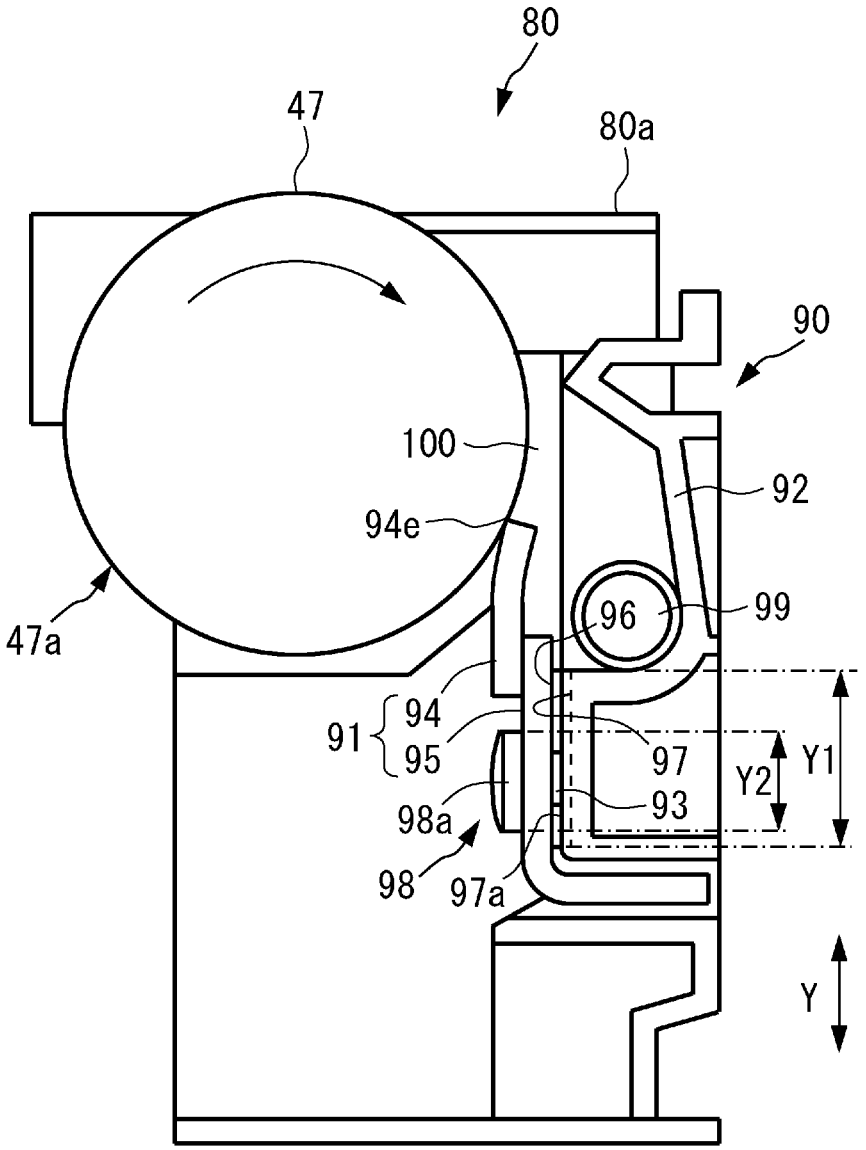
FIG. 2 is a schematic cross-sectional view of a photosensitive (member) unit in the embodiment.
Figure 3:
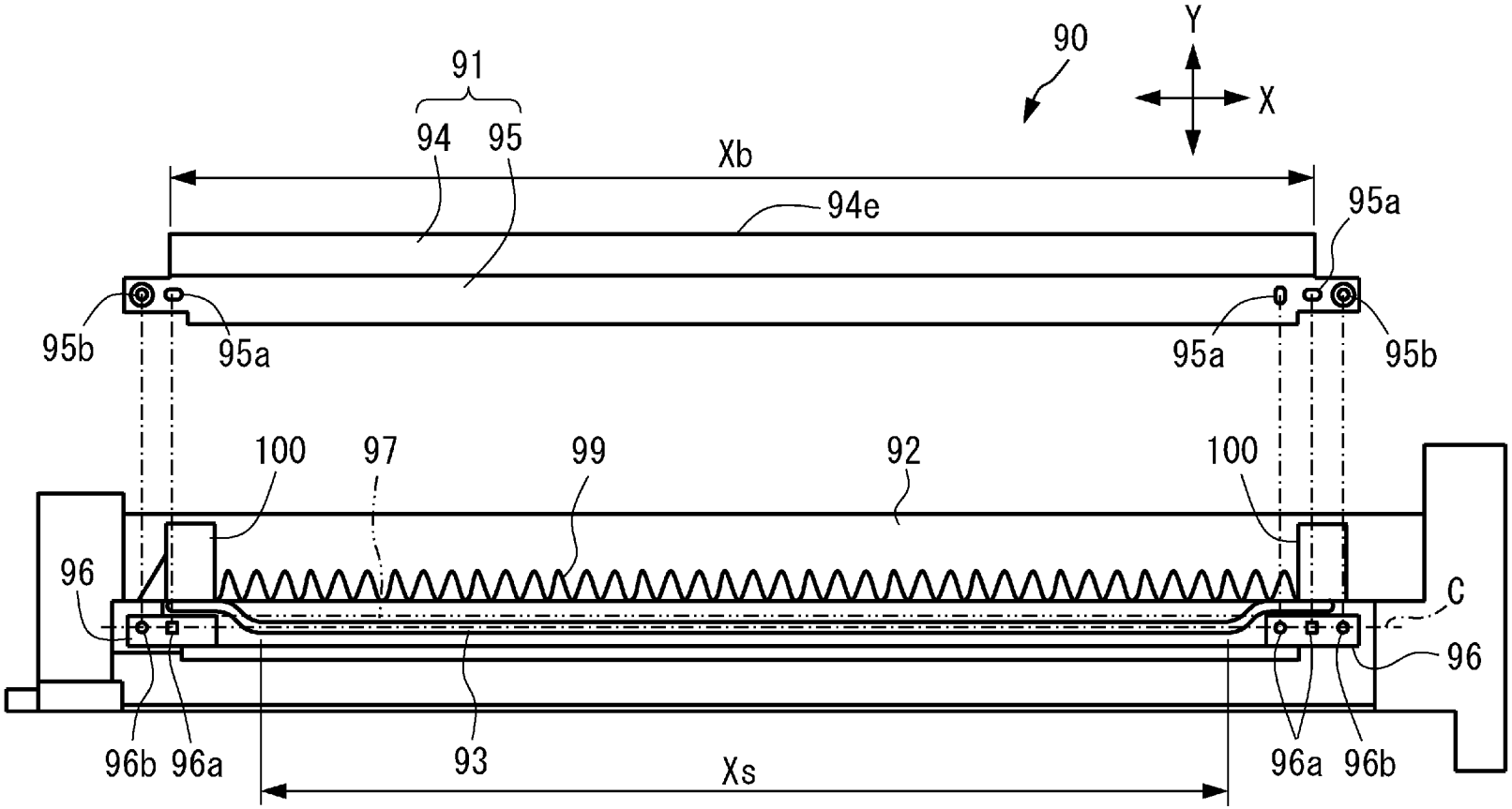
FIG. 3 is a front view of a cleaning device in the embodiment in a state in which a cleaning member cover is demounted from a collecting container.

As shown in FIGS. 2 and 3, the cleaning device 90 provided inside a casing 80*a* of the photosensitive unit 80 includes a cleaning member 91, a collecting container 92 and a sealing material 93.

The cleaning member 91 includes a cleaning blade 94 contacting the photosensitive drum (an object-to-be-cleaned) 47 along a longitudinal direction X, and a supporting plate 95 for supporting the cleaning blade 94. The blade 94 is formed with an elastic member such as an urethane rubber and scrapes off the toner (deposited matter) deposited on a surface 47*a* of the photosensitive drum 47 by rotation (movement) of the photosensitive drum 47. The supporting plate 95 has an L-shape in cross-section and is provided along the longitudinal direction X. The supporting plate 95 and the blade 94 are provided integrally with each other by (adhesive) bonding, for example.

The collecting container 92 is provided along the longitudinal direction X of the photosensitive drum 47, and collects the toner (deposited matter) scraped off from the surface 47*a* of the photosensitive drum 47 by the cleaning blade 94. The collecting container 92 includes a fixing portion 96 and a recessed portion 97 on a side surface in a side opposing the photosensitive drum 47. The fixing portion 96 is disposed at least at two positions spaced from each other with respect to the longitudinal direction X, and the supporting plate 95 is fixed to the two fixing portions 96. The recessed portion 97 is provided between the fixing portions with respect to the longitudinal direction X, and is recessed more than the fixing portions 96 toward a side opposite from the supporting plate 95. Each of the fixing portions 96 has a flat surface constituting a bearing surface in the supporting plate side, and end portions of the supporting plate 95 are hermetically contacted and fixed to the bearing surfaces.

As shown in FIG. 3, each of the fixing portions 96 includes a boss (positioning portion) 96*a* projecting toward the supporting plate 95 for positioning the supporting plate 95 relative to the fixing portion 96 and includes a tapped hole 96*b* threadably engageable with a bolt 98 for fastening. At each of end portions of the supporting plate 95 with respect to the longitudinal direction X, a boss hole 95*a* into which the boss 96*a* is to be inserted and a through hole 95*b* through which the bolt 98 is to be penetrated. Accordingly, the boss hole 95*a* of the supporting plate 95 is engaged with the boss 96*a* of the fixing portion 96, and the boss 96*a* is fastened by the bolt 98, so that the supporting plate 95 can be positioned and fastened to the fixing portion 96. As a result, the supporting plate 95 is fixed to the collecting container 92 so that the blade 94 contacts the photosensitive drum 47 at a predetermined position and at a predetermined pressure.

The sealing material 93 is made of a thermoplastic resin material, for example, and is solid at normal temperature, but is heat-melted and then is fixed by cooling after being applied at a predetermined position. The sealing material 93 applied between the supporting plate 95 and the recessed portion 97 so as to seal between the supporting plate 95 and the recessed portion 97 with respect to a perpendicular direction Y to the longitudinal direction X. That is, the recessed portion 97 is provided for ensuring a space in which the sealing material 93 is prevented from being completely crushed. An application position of the sealing material 93 will be described later.

By forming the fixing portion 96 over an entire region of the collecting container 92 with respect to the longitudinal direction X, even when the sealing material 93 is not used, it is possible to effect sealing between the supporting plate 95 and the collecting container 92. However, it is difficult to mold an entirety of a contact surface of the fixing portion 96 with the supporting plate 95 with high accuracy, so that a cost is increased. Further, the blade 94 receives a reaction force from the photosensitive drum 47, and each of central portions of the supporting plate 95 and the collecting container 92 is bent depending on rigidity, and therefore it is difficult to bring the supporting plate 95 and the collecting container 92 into intimate contact with each other particularly at a portion close to the neighborhood of the central portions with respect to the longitudinal direction X. Accordingly, in order to mold only a necessary region with high accuracy, the fixing portions 96 are disposed separately at the end portions with respect to the longitudinal direction X, and the recessed portion 97 recessed between the fixing portions 96 is disposed, and then the sealing material 93 is applied onto the recessed portion 97, so that scattering and leakage of the transfer residual toner are prevented.

Each of the fixing portions 96 is positioned so that an application portion of the sealing material 93 is ensured at an edge thereof in the blade 94 side ((a) and (b) of FIG. 4) and so that an edge thereof in a side opposite from the blade 94 does not interfere with a bent portion of the supporting plate 95 (FIG. 2).

In the collecting container 92, a feeding screw 99 is rotatably supported along the longitudinal direction X of the photosensitive drum 47. The feeding screw 99 feeds the transfer residual toner, dropped from an edge 94*e* of the blade 94, along the longitudinal direction X. The collecting container 92 is provided with an unshown collecting portion for collecting the transfer residual toner fed by the feeding screw 99 in the longitudinal direction X.

At a portion of the collecting container 92 opening each of the end portions of the photosensitive drum 47 with respect to the longitudinal direction X, a drum seal (object sealing portion) 100 for sealing between the photosensitive drum 47 and the collecting container 92 with respect to the longitudinal direction X in contact with the photosensitive drum 47. The drum seal 100 is made of, e.g., nonwoven fabric and is provided by being applied onto the collecting container 92, and is press-contacted from the collecting container 92 toward the photosensitive drum 47.

An operation of the cleaning device 90 will be described based on FIGS. 2 and 3. When an image forming operation is carried out in the image forming apparatus 1, the photosensitive drum 47 is rotated in an arrow direction (FIG. 2) by an unshown driving mechanism. The edge 94*e* of the blade 94 contacts the surface 47*a* of the photosensitive drum 47, and the transfer residual toner deposited on the surface 47*a* of the photosensitive drum 47 is scraped off and removed from the surface 47*a*. Then, the feeding screw 99 rotates and feeds the transfer residual toner dropped from the edge 94*e* of the blade 94, and the transfer residual toner is collected by the unshown collecting portion.

A part of the transfer residual toner scraped off from the edge 94*e* of the blade 94 enters between the supporting plate 95 and the recessed portion 97 of the collecting container 92. However, between the supporting plate 95 and the recessed portion 97, the sealing material 93 is provided, and therefore it is possible to prevent the transfer residual toner from passing through between the supporting plate 95 and the recessed portion 97 in the perpendicular direction Y to cause scattering and leakage-out toward an outside of the collecting container 92. Similarly, between the photosensitive drum 47 and the collecting container 92, the drum seal 100 is provided, and therefore it is possible to prevent the transfer residual toner from passing through between the photosensitive drum 47 and the collecting container 92 in the longitudinal direction X to cause scattering and leakage-out toward the outside of the collecting container 92.

An application position of the sealing material 93 at the recessed portion 97 will be described in detail using FIG. 3 to (b) of FIG. 4.

The sealing material 93 is applied within a range Y1 of the fixing portion 96 with respect to the perpendicular direction Y to the longitudinal direction X at the recessed portion 97, so that the sealing material 93 seals between the supporting plate 95 fixed to the fixing portion 96 and the recessed portion 97 with respect to the perpendicular direction Y. The sealing material 93 seals between the supporting plate 95 and the recessed portion 97, whereby scattering and leakage-out of the toner from the collecting container 92 toward the outside are prevented.

In this embodiment, the sealing material 93 is applied nearly within the range Y1 of the fixing portion 96. That is, the sealing material 93 is applied in a linear shape narrower than the fixing portion 96 with respect to the perpendicular direction Y. For this reason, compared with the case where the sealing material 93 is applied outside the fixing portion 96 with respect to the perpendicular direction Y, an influence of a moment generated in the supporting plate 95 can be suppressed.

In this embodiment, the sealing material 93 is applied in a portion 97*a* within a diameter range Y2 of a head 98*a* of each of the bolts 98 in the range Y1 of the fixing portion 96. That is, the sealing material 93 is applied between the bolts 98 for the spaced fixing portions 96 and within the diameter range Y2 of the head 98*a* of the bolt 98 with respect to the perpendicular direction Y. For this reason, compared with the case where the sealing material 93 is applied onto a portion out of the diameter range Y2 of the head 98*a*, the influence of the moment generated in the supporting plate 95 can be further suppressed.

In this embodiment, the sealing material 93 is applied onto the recessed portion 97 so as to overlap with a center line C in the diameter range Y2 of the head 98*a*. For this reason, compared with the case where the sealing material 93 is applied onto a portion other than the center line C, the influence of the moment generated in the supporting plate 95 can be further suppressed.

Therefore, an application position where a large influence of the moment on the supporting plate 95 is not exerted by the sealing material 93 is at least within the range Y1 of the fixing portion 96, preferably within the diameter range Y2 of the head 98*a*, most preferably on the center line C.

From the above, also mounting positions of the boss 96*a* and the tapped hole 96*b* of the fixing portion 96 are at least within the range Y1 of the fixing portion 96, preferably within the diameter range Y2 of the head 98*a*, most preferably on the center line C. Particularly, the blade 94 receives a repelling force from the photosensitive drum 47 and the sealing material 93. For this reason, in order to suppress a moment from being generated around the fixing portion 96, the application position of the sealing material 93 and the mounting positions of the boss 96*a* and the tapped hole 96*b* of the fixing portion 96 may preferably be aligned with the center line C. Incidentally, in this embodiment, the sealing material 93 is applied in a linear shape connecting the bosses 96*a* (positioning portions) of the spaced fixing portions 96.

In this embodiment, rigidity of the supporting plate 95 and the collecting container 92 is properly ensured, so that the blade 94 satisfies a predetermined contact pressure and a predetermined pressure distribution. In this case, when a relationship between a longitudinal dimension Xs of the sealing material 93 and a longitudinal dimension Xb of the blade 94 on the center line C satisfies $Xs \geq 0.8 \times Xb$, the contact pressure of the blade 94 is not influenced.

As shown in (a) and (b) of FIG. 4, the sealing material 93 is applied so as to draw a smooth locus toward an upper side (edge line) of the fixing portion 96 in the neighborhood of each of end portions thereof with respect to the longitudinal direction X, and contacts a lower side of the drum seal 100.

That is, the sealing material 93 is applied and extended to at least a position where the sealing material 93 contacts the drum seal 100. As a result, the transfer residual toner scraped off by the blade 94 does not leak out through also between the sealing material 93 and the drum seal 100, so that a sealing property can be improved. In this embodiment, the sealing material 93 is applied so as to draw the smooth locus toward the upper side of the fixing portion 96 and therefore it is possible to prevent stagnation of the sealing material 93 generating at a corner of a folding line (zig-zag line) as in the case where a locus of a linear folding line is drawn to the drum seal 100. As a result, a thickness of the sealing material 93 can be made constant, so that the sealing property can be improved.

As described above, according to the cleaning device 90 in this embodiment, the sealing material 93 is applied within the range Y1 of the fixing portion 96 with respect to the perpendicular direction Y at the recessed portion 97 of the collecting container 92, and thus seals between the recessed portion 97 and the supporting plate 95 fixed to the fixing portion 96 with respect to the perpendicular direction Y. For this reason, the influence on the contact pressure of the blade 94 can be suppressed while maintaining the sealing property.

Further, according to the cleaning device 90 in this embodiment, the bosses 96*a* and the sealing material 93 are provided on the same rectilinear liner, so that the contact position of the blade 94 is maintained and thus it is possible to prevent leakage of the transfer residual toner from between the supporting plate 95 and the collecting container 92. Further, by smoothly applying the sealing material 93 so that the end portions of the sealing material 93 with respect to the longitudinal direction X contacts the edge lines of the drum seals 100, the sealing property can be further improved.

In this embodiment, the sealing material 93 is applied in the linear shape so as not to exert the influence on the contact pressure of the blade 94, but the present invention is not limited thereto. For example, the sealing material 93 may also be applied in such a shape that a central portion 93*a* thereof is bent toward one side with respect to the perpendicular direction Y.

Here, the collecting container 92 supports the photosensitive drum 47 at both end portions thereof and receives the reaction force of the blade 94 from the fixing portion 96, and therefore the collecting container 92 is bent at the central portion. Due to a factor such as a space, in the case where the rigidity of the collecting container 92 cannot be ensured, the blade 94 has reduced pressure at the central portion relative to the photosensitive drum 47, so that there is a possibility that the pressure distribution becomes non-uniform and thus improper cleaning generates. Therefore, as shown in (a) of FIG. 5, the pressure distribution can be adjusted to a uniform pressure distribution by applying the sealing material 93 so that the central portion 93*a* of the sealing material 93 is projected toward the blade 94.

Figure 5:
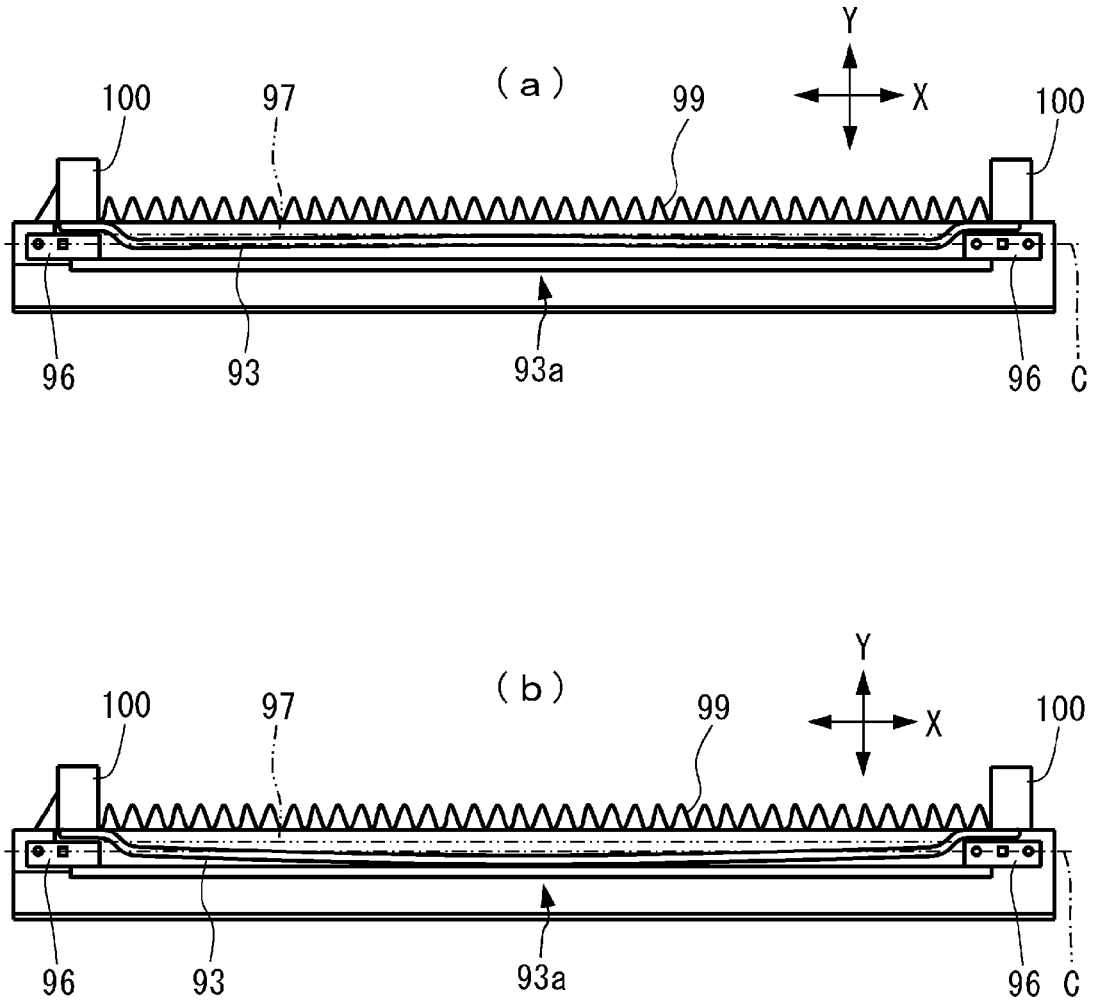
In FIG. 5, (a) and (b) are schematic views each showing a modified example of the cleaning device in the embodiment, wherein (a) shows the case where a central portion of a sealing material is bent toward a cleaning blade, and (b) shows the case where the central portion of the sealing material is bent toward a side opposite from the cleaning blade.

On the other hand, in the case where the rigidity of the collecting container is sufficiently ensured, as shown in (b) of FIG. 5, the pressure distribution can be adjusted to a uniform pressure distribution by applying the sealing material so that the central portion 93*a* of the sealing material 93 is recessed relative to the blade 94.

In this embodiment, the photosensitive drum 47 as the image bearing member which is the object-to-be-cleaned is cleaned, but the present invention is not limited thereto. For example, a similar effect can be obtained also when cleaning of the intermediary transfer belt 44*b* is effected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-005622 filed on Jan. 15, 2015, which is hereby incorporated by reference herein in its entirety.

What is claimed is:

1. A cleaning device for cleaning an image bearing member for bearing an image, comprising:

a cleaning member including a cleaning blade for removing a developer on the image bearing member and a supporting plate for supporting said cleaning blade;

a frame for supporting said cleaning blade and for collecting the developer scraped off by said cleaning blade;

first and second fixing portions, provided on said frame, for fixing said supporting plate in one end side and the other end side with respect to a longitudinal direction of said cleaning blade;

a recessed portion provided on said frame at a position between said first and second fixing portions with respect to the longitudinal direction and recessed more than said first and second fixing portions in a direction away from said supporting plate;

a sealing material, applied onto said recessed portion within a range of said first and second fixing portions with respect to a widthwise direction of said first and second fixing portions perpendicular to the longitudinal direction, for sealing between said supporting plate fixed on said first and second fixing portions and said recessed portion; and an object sealing portion, provided on said collecting container at a portion opposing each end portion of the image bearing member with respect to the longitudinal direction, for sealing between the image bearing member and said collecting container, wherein said sealing material is applied and extended at least to a position of contact with said object sealing portion, and wherein with respect to the widthwise direction of said first and second fixing portions perpendicular to the longitudinal direction, said sealing material is disposed more at a side where said first and second fixing portions are provided than at a side where the object sealing portion is provided, and includes a contact portion contacting said object sealing portion.

2. A cleaning device according to claim 1, wherein said sealing material is applied in a rectilinear shape thinner than said fixing portions with respect to the widthwise direction of said first and second fixing portions.

3. A cleaning device according to claim 1, wherein said fixing portions include positioning portions for positioning said supporting plate relative to said fixing portions, and wherein said sealing material is applied is a rectilinear shape connecting said positioning portions, of said fixing portions spaced from each other, with each other.

4. A cleaning device according to claim 1, further comprising bolts for fastening said supporting plate to said fixing portions, wherein said sealing material is applied between said bolts for said fixing portions spaced from each other and within a range of a head portion of each of said bolts with respect to the perpendicular direction.

5. A cleaning device according to claim 1, wherein said sealing material is applied between said fixing portions so that a central portion is bent toward one side with respect to the perpendicular direction.

6. A cleaning device according to claim 1, wherein said sealing material is a thermoplastic resin material.

7. A cleaning device according to claim 1, wherein said sealing material is extended to a region of each of said fixing portions with respect to the longitudinal direction, and is applied at a position toward said cleaning blade more than said fixing portions with respect to the perpendicular direction.

8. A cleaning device comprising:

a cleaning blade configured to remove toner on an image bearing member via contact with the image bearing member;

a metal plate configured to support said cleaning blade;

a first screw configured to fix one end of said metal plate;

a second screw configured to fix the other end of said metal plate;

a cleaning container configured to accommodate said cleaning blade and configured to collect the toner removed by said cleaning blade;

a first projected flat surface portion including a first bearing portion for fixing said first screw and projecting from a surface of said cleaning container at a position corresponding to one side of said cleaning blade with respect to a longitudinal direction of said cleaning blade;

a second projected flat surface portion including a second bearing portion for fixing said second screw and projecting from the surface of said cleaning container at a position corresponding to the other side of said cleaning blade with respect to the longitudinal direction of said cleaning blade;

a first end portion seal provided at one end portion of said cleaning blade with respect to the longitudinal direction and configured to seal between said cleaning container and the image bearing member;

a second end portion seal provided at the other end portion of said cleaning blade with respect to the longitudinal direction and configured to seal between said cleaning container and the image bearing member; and a seal member provided along the longitudinal direction of said cleaning blade between said metal plate and said cleaning container and configured to seal between said metal plate and said cleaning container, said seal member extending to a position contacting said first end portion seal and to a position contacting said second end portion seal, wherein with respect to a widthwise direction of said first projected flat surface portion and said second projected flat surface portion, perpendicular to the longitudinal direction of said cleaning blade, said seal member includes a first region provided within a range of said first projected flat surface portion and said second projected flat surface portion and includes a second region provided out of the range of said first projected flat surface portion and said second projected flat surface portion, the first region occupying 80% or more as a proportion thereof to a longitudinal width of said cleaning blade, and wherein said seal member includes an extended portion extended along the longitudinal direction of said cleaning blade and an inclined portion which is inclined with respect to the longitudinal direction of said cleaning blade and which connects the first region and the second region.

9. A cleaning device according to claim 8, wherein with respect to the widthwise direction, said seal member includes a third region positioned within a range of head portions of said first and second screws, the third region occupying 80% or more as a proportion thereof to a longitudinal width of said cleaning blade.

10. A cleaning device according to claim 8, wherein said seal member is an elastic member formed of a thermoplastic resin material applied onto said cleaning container.

11. A cleaning device comprising:

a cleaning blade configured to remove toner on an image bearing member via contact with the image bearing member;

a metal plate configured to support said cleaning blade;

a first screw configured to fix one end of said metal plate;

a second screw configured to fix the other end of said metal plate;

a cleaning container configured to accommodate said cleaning blade and configured to collect the toner removed by said cleaning blade;

a first projected flat surface portion including a first bearing portion for fixing said first screw and projecting from a surface of said cleaning container at a position corresponding to one side of said cleaning blade with respect to a longitudinal direction of said cleaning blade;

a second projected flat surface portion including a second bearing portion for fixing said second screw and projecting from the surface of said cleaning container at a position corresponding to the other side of said cleaning blade with respect to the longitudinal direction of said cleaning blade;

a first end portion seal provided at one end portion of said cleaning blade with respect to the longitudinal direction and configured to seal between said cleaning container and the image bearing member;

a second end portion seal provided at the other end portion of said cleaning blade with respect to the longitudinal direction and configured to seal between said cleaning container and the image bearing member; and a seal member provided along the longitudinal direction of said cleaning blade between said metal plate and said cleaning container and configured to seal between said metal plate and said cleaning container, said seal member extending to a position contacting said first end portion seal and to a position contacting said second end portion seal, wherein with respect to a widthwise direction of said first projected flat surface portion and said second projected flat surface portion, perpendicular to the longitudinal direction of said cleaning blade, said seal member includes a first region provided within a range of said first projected flat surface portion and said second projected flat surface portion and includes a second region provided out of the range of said first projected flat surface portion and said second projected flat surface portion, the first region occupying 80% or more as a proportion thereof to a longitudinal width of said cleaning blade, wherein said seal member is provided between said first end portion seal and said first projected flat surface portion so as to extend in the longitudinal direction of said cleaning blade, and at least a part of said seal member contacts said first end portion seal, and wherein said seal member is provided between said second end portion seal and said second projected flat surface portion so as to extend in the longitudinal direction of said cleaning blade, and at least a part of said seal member contacts said second end portion seal.

12. A cleaning device according to claim 11, wherein with respect to the widthwise direction, said seal member includes a third region positioned within a range of head portions of said first and second screws, the third region occupying 80% or more as a proportion thereof to a longitudinal width of said cleaning blade.

13. A cleaning device according to claim 11, wherein said seal member is an elastic member formed of a thermoplastic resin material.

* * * * *